US007847171B1

(12) United States Patent
Kidd, III

(10) Patent No.: US 7,847,171 B1
(45) Date of Patent: Dec. 7, 2010

(54) GUITAR WITH PICK SUPPORT

(76) Inventor: John L. Kidd, III, 780 Montgomery St., Mandeville, LA (US) 70448

( * ) Notice: Subject to any disclaimer, the term of this patent is extended or adjusted under 35 U.S.C. 154(b) by 0 days.

(21) Appl. No.: 12/509,574

(22) Filed: Jul. 27, 2009

Related U.S. Application Data

(60) Provisional application No. 61/084,469, filed on Jul. 29, 2008.

(51) Int. Cl.
*G10D 3/00* (2006.01)

(52) U.S. Cl. ..... 84/329

(58) Field of Classification Search ..... 84/329
See application file for complete search history.

(56) References Cited

U.S. PATENT DOCUMENTS

| | | | | | |
|---|---|---|---|---|---|
| 70,500 | A | | 11/1867 | Averell | |
| 635,283 | A | | 10/1899 | Adair | |
| 2,138,914 | A | * | 12/1938 | Frey | 211/120 |
| 2,366,483 | A | | 1/1945 | Bona | |
| 2,482,258 | A | * | 9/1949 | Black et al. | 206/8 |
| 3,738,499 | A | * | 6/1973 | Takamizawa et al. | 211/120 |
| 3,752,029 | A | * | 8/1973 | Watrous | 84/329 |
| 4,467,693 | A | | 8/1984 | Nasfell, Jr. | |
| 4,527,577 | A | * | 7/1985 | Miller et al. | 453/12 |
| 4,547,923 | A | * | 10/1985 | DeVries et al. | 15/104.001 |
| 4,886,173 | A | * | 12/1989 | Goulter | 211/89.01 |
| 4,890,531 | A | * | 1/1990 | Tischer | 84/329 |
| 4,925,516 | A | * | 5/1990 | Phillips et al. | 156/252 |
| 5,299,485 | A | | 4/1994 | Denton | |
| D355,667 | S | | 2/1995 | Burger | |
| 5,649,634 | A | * | 7/1997 | Irizarry | 211/120 |
| 5,651,468 | A | * | 7/1997 | Irizarry | 211/120 |
| 6,215,052 | B1 | * | 4/2001 | Giddens et al. | 84/329 |
| D555,461 | S | * | 11/2007 | Tincher | D8/370 |
| 7,566,824 | B2 | * | 7/2009 | Small | 84/318 |

* cited by examiner

*Primary Examiner*—Jeffrey Donels
*Assistant Examiner*—Robert W Horn
(74) *Attorney, Agent, or Firm*—Garvey, Smith, Nehrbass & North, L.L.C.; Brett A. North

(57) ABSTRACT

A guitar with pick holder apparatus provides a coil spring that is attachable to the guitar strings at a position next to the tuners. The coil spring has end portions with handles that are positioned to provide left and right gripping surfaces or grasping surfaces for the hands of a user, thus enabling the user to grip and stretch or bend the spring and provide gaps between the spring coils. These gaps between spring coils enable strings of the guitar to occupy the gaps so that when the loops are released, the coils attempt to return to an original coil spring position, thus grasping each guitar string in between two coils of the coil spring.

15 Claims, 4 Drawing Sheets

GUITAR WITH PICK SUPPORT

CROSS-REFERENCE TO RELATED APPLICATIONS

Priority of U.S. Provisional Patent Application Ser. No. 61/084,469, filed Jul. 29, 2008, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to stringed instruments such as guitars having a body, neck, strings and tuners or tuning machines wherein a guitar pick holder is supported on the neck or strings, near the tuning machines or tuners, the pick holder being in the form of a coil spring that expands, providing gaps between the coils that receive the guitar strings and when released compress to hold the coil spring in position on the strings. Picks can then be supported in between two coils of the springs.

2. General Background of the Invention

Stringed instrument (e.g. guitar, banjo, mandolin) players employ a pick that has a larger end portion gripped between the thumb and forefinger of the player and a smaller usually pointed or tapered end portion that engages and then disengages a selected guitar string, thus imparting a vibration to the string as is known.

Picks must be stored when the musician has finished playing the guitar or is taking a break for example.

Patents have issued that provide pick holders. An example is U.S. Pat. No. 5,796,021 entitled "Pick Holder for Guitars and Other String Instruments".

U.S. Pat. No. 5,413,020 is the subject of a retracting guitar pick holder which provides a wrist band of cloth leather or the like onto which is fastened a tube which extends over the hand. Inside the tube is an elastic cord fastened to the wrist end of the tube. If the fingers end, the cord is attached either to the pick directly or to a clasp which is used to hold the pick.

Another pick holder is the subject of U.S. Pat. No. 5,488,892.

U.S. Pat. No. 6,639,136 provides a pick holder that is secured in the strings of a stringed instrument, specifically a guitar. The pick holder includes an enlarged attaching base that is inserted in between two of the strings of the instrument. The base of the pick holder is placed between the two strings and the pick holder is then rotated so that the base is secured between the strings and the upper end of the neck of the guitar above the first fret. The main body of the pick holder includes a plurality of tapered slots to hold picks. An upper wedge of the main body provides a securing pressure against lower retaining portions.

U.S. Pat. No. 6,933,430 describes a guitar pick holder made of a flexible magnetic body.

These and other possibly relevant patents are listed in the following table.

TABLE

| U.S. Pat. No. | TITLE | ISSUE DATE |
|---|---|---|
| 70,500 | Card Holder | Nov. 5, 1867 |
| 635,283 | Rack for Penholders | Oct. 24, 1899 |
| 2,366,483 | Holder for Pencils or Pens | Jan. 2, 1945 |
| 2,482,258 | Coin Holder | Sep. 20, 1949 |
| 3,752,029 | Pick Holder | Aug. 14, 1973 |
| 4,467,693 | Holder for Guitar Plectra | Aug. 28, 1984 |
| 4,890,531 | Musical Instrument Pick Holder | Jan. 2, 1990 |
| 5,299,485 | Stringed Instrument Pick and Slide Holder | Apr. 5, 1994 |
| Des. 355,667 | Guitar Pick Holder | Feb. 21, 1995 |
| 5,649,634 | Holder for Thin Planar Objects | Jul. 22, 1997 |
| 6,215,052 | Guitar Pick Holder | Apr. 10, 2001 |
| Des. 355,667 | Guitar Pick Holder | Feb. 21, 1995 |
| 5,649,634 | Holder for Thin Planar Objects | Jul. 22, 1997 |
| 6,215,052 | Guitar Pick Holder | Apr. 10, 2001 |

BRIEF SUMMARY OF THE INVENTION

The present invention provides an improved stringed instrument (e.g. guitar) and pick holder apparatus. The stringed instrument can provide a body having a neck and strings. The strings extend from the guitar body to the tuners or tuning machines that enable string tension to be adjusted.

A coil spring provides end portions with handles that are positioned to provide left and right grasping surfaces for the hands of the user or musician. These handles enable the user or musician to grip and stretch the spring to provide gaps between the spring coils.

The spring coil can then be mounted on a guitar at the guitar strings and at a position near the tuners, preferably above the fret that is closest to the tuners. Two of the coils of the coil spring are positioned on opposite sides of each guitar string for gripping the guitar string therebetween. Compression of two coils on a string thus holds the coil spring to the string. In the preferred embodiment, there are sufficient number of the coils to enable all six strings of a guitar to be gripped by coils. Picks can be placed in between any two selected coils of the spring.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figures 1, 2:
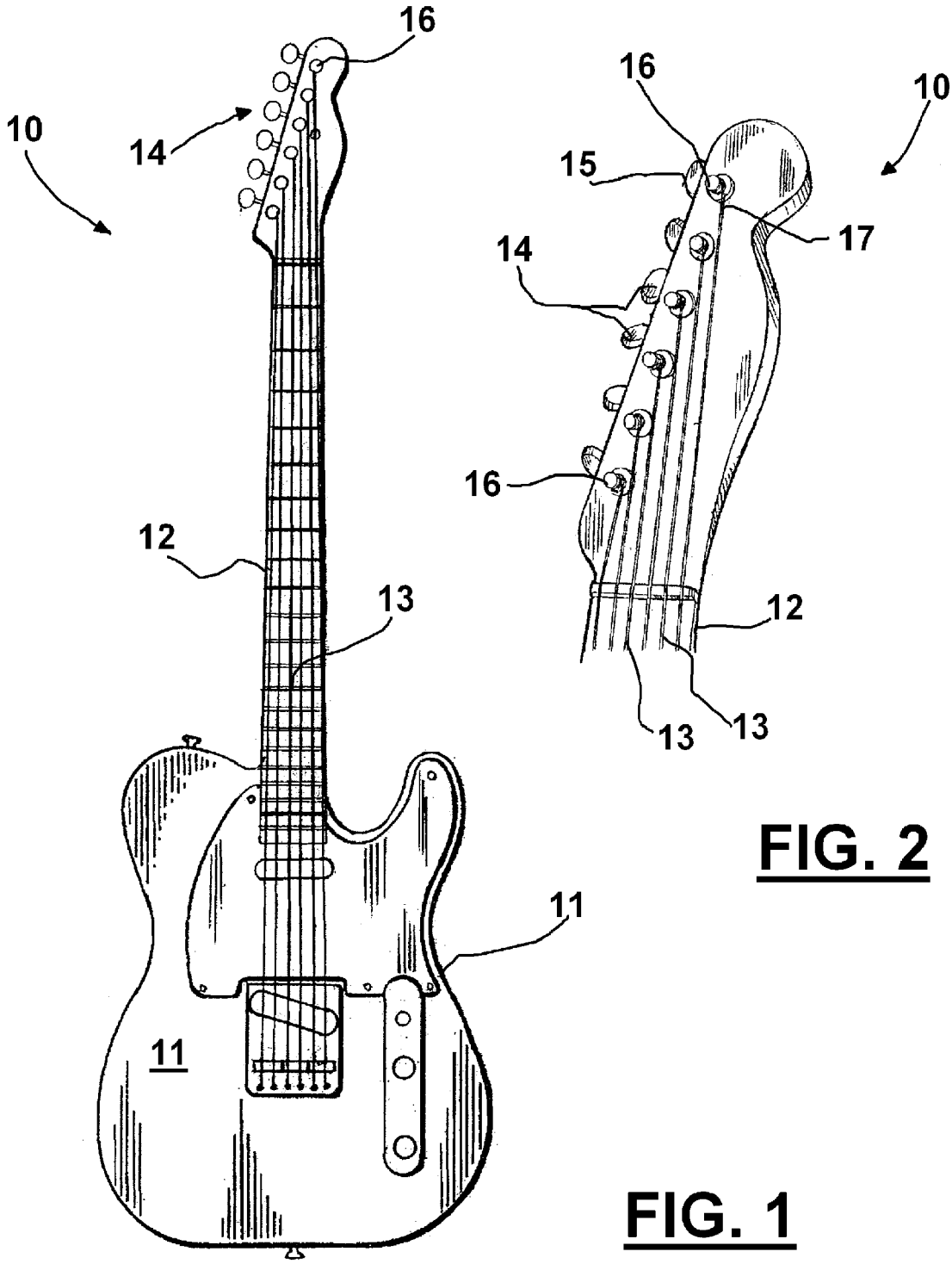
FIG. 1 is a front perspective view of the preferred embodiment of the apparatus of the present invention.
FIG. 2 is a fragmentary front perspective view of the preferred embodiment of the apparatus of the present invention.
Figure 3:
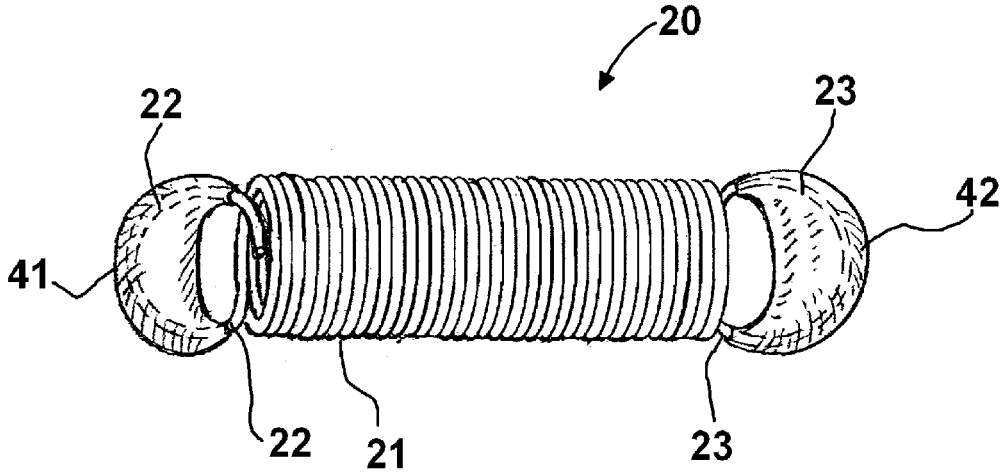
FIG. 3 is a front partial perspective view of the preferred embodiment of the apparatus of the present invention.
Figure 4:
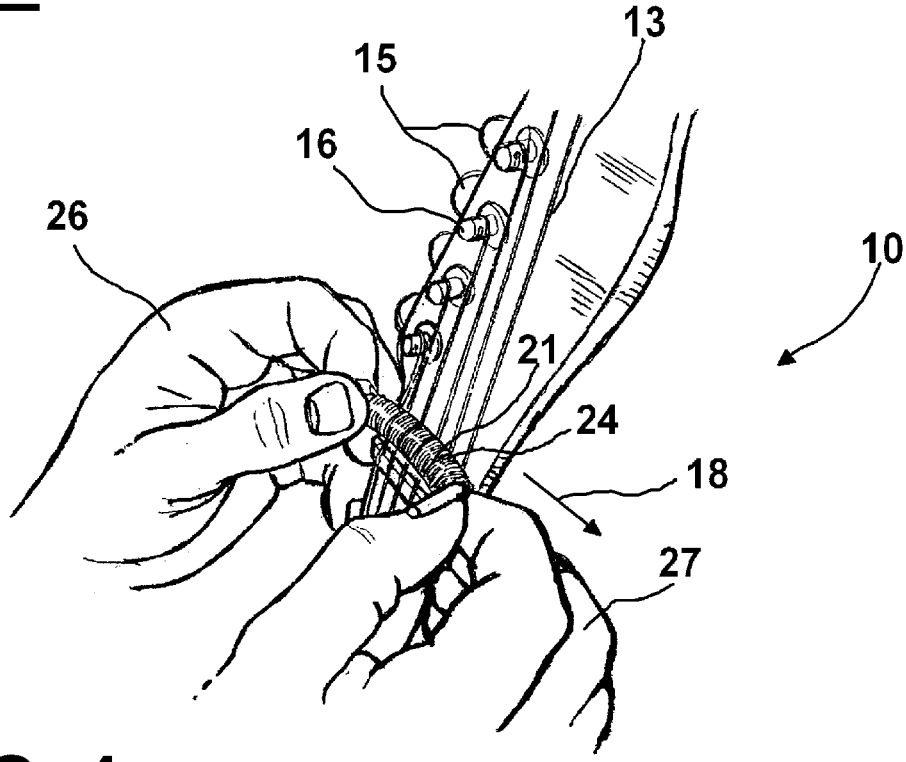
FIG. 4 is a perspective view of the preferred embodiment of the apparatus of the present invention.
Figure 5:
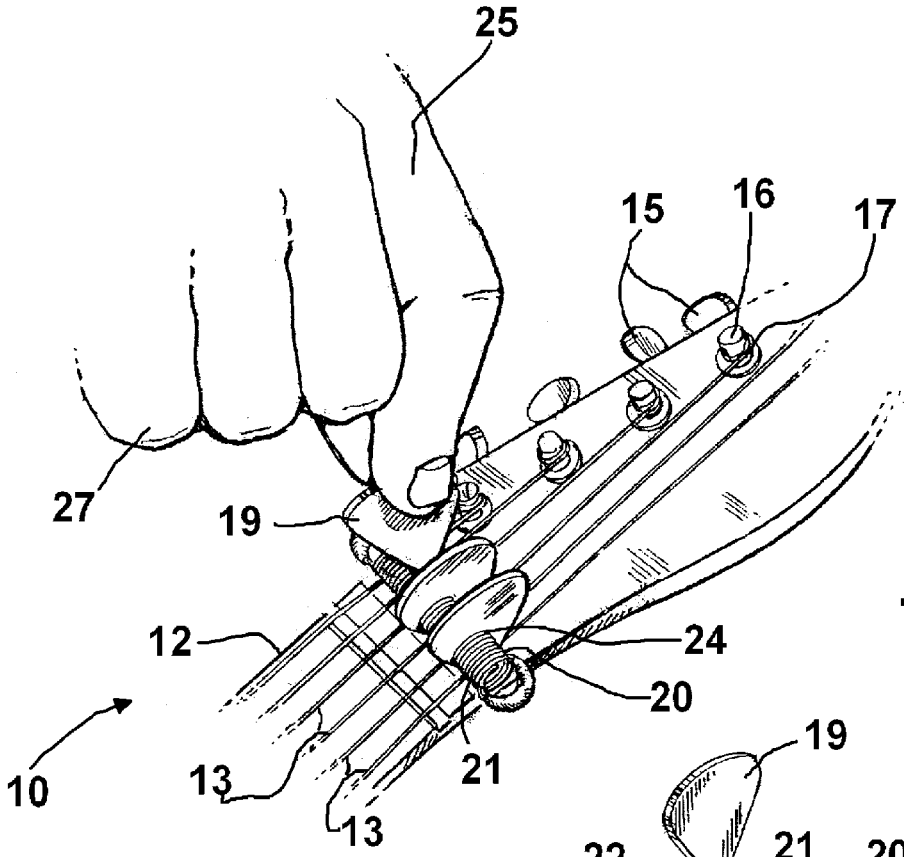
FIG. 5 is another perspective view of the preferred embodiment of the apparatus of the present invention.

FIGS. 1-6 show the preferred embodiment of the apparatus of the present invention, designated generally by the numeral 10. Instrument with pick holder 10 can provide a body 11 to which is attached an elongated neck 12. Multiple strings 13 (for example, six strings) extend from the body to the neck and then to a plurality of tuners or tuning machines 14. The tuners 14 are known in the art, each providing a thumb screw 15 and a peg or shaft 16 upon which a string 13 is connected and wound.

When the thumb screw 15 is adjusted, string tension can be selectively increased or lowered. The thumb screw 15 is rotated by the hand 26, 27 of a user or musician 25. When the thumb screw 15 is rotated, the shaft 16 also rotates. The connection 17 of each string to a shaft 16 of tuner 14 can be in the form of a slot into which the string 13 is placed and then the string 13 is wound about the shaft 16 when the user or musician 25 rotates the thumb screw 15. Strings 13 and tuners 14 are commercially available.

Figure 6:
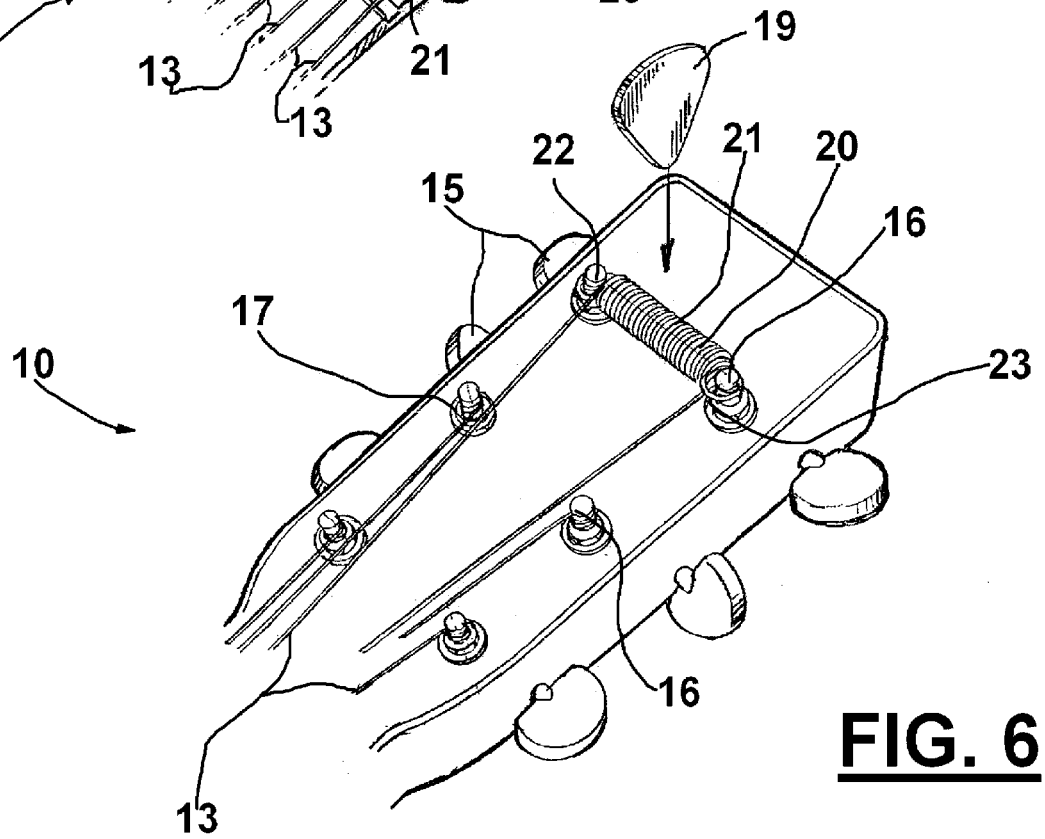
FIG. 6 is a perspective view of the preferred embodiment of the apparatus of the present invention.

A pick 19 is used to play the stringed instrument (e.g. guitar). Pick holder 20 (see FIGS. 1-4) enables multiple picks 19 to be supported on the guitar 10. The pick holder 20 is preferably in the form of a coil spring 21 that can be generally cylindrically shaped. The coil spring 21 has a loop 22 at one end portion and another loop 23 at the other end portion. These loops, 22, 23 function as handles and provide gripping surfaces or handles 41, 42 that enable a user or musician 25 to grasp the loops 22, 23 or handles 41, 42 with his or her hands 26, 27 respectively (see arrows 18, FIG. 4). The user or musician 25 then pulls the loops 22, 23 or handles 41, 42 in opposite directions, thus providing gaps 24 in between coils 28, 29 of the coil spring 21. These gaps enable the musician 25 to place the coil spring 21 upon the six strings 13, wherein each string 13 occupies one of the gaps 24 that are produced when the user or musician 25 pulls the loops 22, 23 apart. Alternatively, the user or the musician 25 can use the loops 22, 23 or handles to bend the coil spring 21 into an arc shape which also produces gaps 24 when placing the coil spring 21 on the strings 13. The coil spring 21 can optionally be of a length in between the loops 22, 23 that are sufficiently long so that the coil spring 21 can be attached to all six of the strings 13 of the guitar 10 (see FIGS. 4-5). In FIG. 6, the loops 22, 23 attach to a pair of pegs 16 for the acoustic guitar shown wherein the pegs 16 are arranged in two rows.

Figure 7:
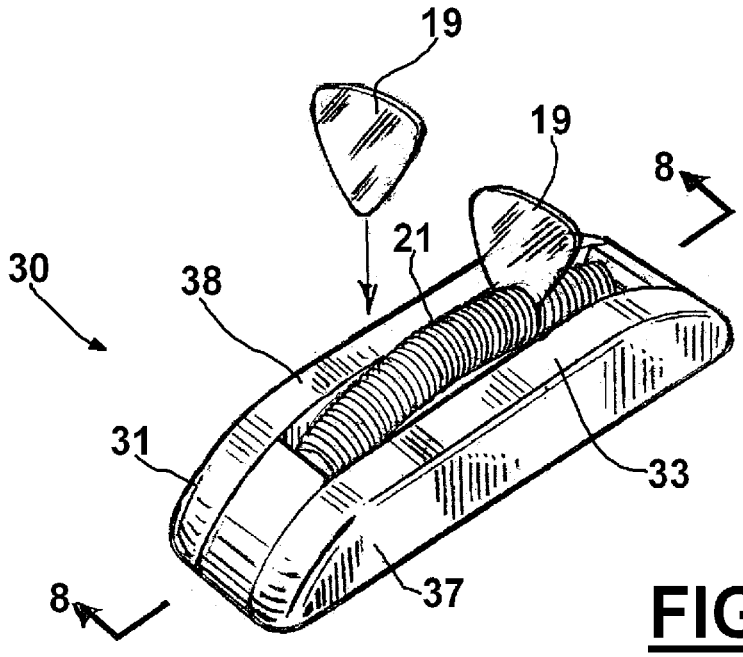
FIG. 7 is a perspective view of a second embodiment of the apparatus of the present invention.
Figure 8:
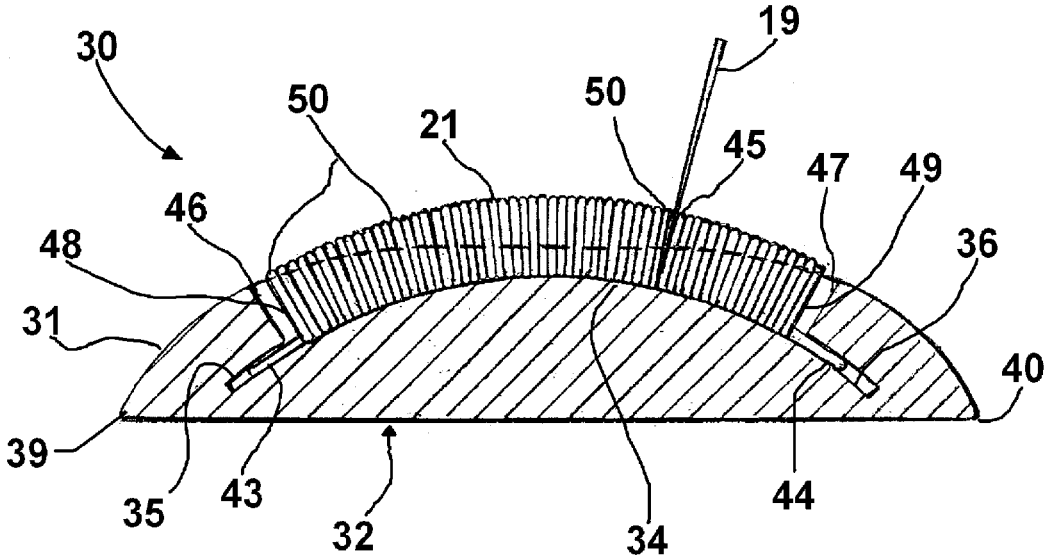
FIG. 8 is a sectional view of the second embodiment of the apparatus of the present invention, taken along lines 8-8 of FIG. 7.

FIGS. 7 and 8 show another embodiment of the apparatus of the present invention, designated generally by the numeral 30. Guitar pick holder 30 utilizes a coil spring 21 with loops 43, 44. The guitar pick holder 30 provides a support 31 having a flat lower surface 32 for engaging an underlying support surface. Support 31 provides an upper portion 33 having a curved surface 34. Sockets 35, 36 are positioned at opposing ends of curved surface 34. These sockets 35, 36 are receptive of the handles or loops 22, 23 that are apart of coil spring 21. Support 31 can provide sides 37, 38 and ends 39, 40. Loops 43, 44 typically track surface 34 (see FIG. 8). Stops 46, 47 are spaced from the ends 48, 49 of spring 21. This enables spring 21 to expand before its ends 48, 49 contact stops 46, 47 so that more than one pick 19 can occupy a gap 45 between two coils 50 of spring 21. Support 31 can be of wood, metal, stone, plastic or synthetic material. It can be illuminated such as by internal bulb or LED. If support 31 were of a clear plastic for example, it would illuminate and glow when fitted with a bulb or LED, thus making it easier for a musician to locate his or her pick during a concert wherein lighting can be poor.

It should be noted that the relative size of any embodiment is not to be controlling. Any embodiment can be increased or decreased in size and still be usable. Additionally, any embodiment can be used in combination with guitar models or gaming systems using guitars (such as the Guitar Hero game).

The following is a list of parts and materials suitable for use in the present invention.

PARTS LIST

| PARTS LIST | |
|---|---|
| Part Number | Description |
| 10 | guitar with pick holder |
| 11 | guitar body |
| 12 | neck |
| 13 | string |
| 14 | tuner |
| 15 | thumb screw |
| 16 | peg/shaft |
| 17 | connection |
| 18 | arrow |
| 19 | pick |
| 20 | pick holder |
| 21 | coil spring |
| 22 | loop |
| 23 | loop |
| 24 | gap |
| 25 | user/musician |
| 26 | hand |
| 27 | hand |
| 28 | coil |
| 29 | coil |
| 30 | guitar pick holder |
| 31 | support |
| 32 | lower surface |
| 33 | upper portion |
| 34 | curved surface |
| 35 | socket |
| 36 | socket |
| 37 | side |
| 38 | side |
| 39 | end |
| 40 | end |
| 41 | handle |
| 42 | handle |
| 43 | loop |
| 44 | loop |
| 45 | gap |
| 46 | stop |
| 47 | stop |
| 48 | end |
| 49 | end |
| 50 | coil |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A guitar with pick holder apparatus, comprising:

a) a guitar body having neck, strings and tuners that enable string tension to be adjusted;

b) a coil spring having end portions with handles that are positioned to provide left and right grasping surfaces for the hands of user, enabling a user to grip and stretch the spring and provide gaps between the spring coils;

c) the coil spring being mounted on the guitar strings at a position near the tuners, wherein two coils of the coil spring are positioned on opposite sides of a guitar string for gripping the guitar string and holding the coil spring to the guitar string.

2. The guitar and guitar pick holder apparatus of claim 1 wherein the coil spring handles are part of the wire that forms the coil spring.

3. The guitar and guitar pick holder apparatus of claim 1 wherein the coil spring handles are loops.

4. The guitar and guitar pick holder apparatus of claim 1 wherein the loops are part of the wire that forms the coil spring.

5. The guitar and guitar pick holder apparatus of claim 1 wherein the coil spring has a central longitudinal axis and the handles generally parallel to said central longitudinal axis.

6. The guitar and guitar pick holder apparatus of claim 1 wherein the coil spring is generally cylindrically shaped.

7. The guitar and guitar pick holder apparatus of claim 1 wherein the coil spring is attached to the thumbscrews.

8. The guitar and guitar pick holder apparatus of claim 3 wherein the loops are attached to two of the thumbscrews.

9. The guitar and guitar pick holder apparatus of claim 8 wherein each loop encircles a thumbscrew.

10. A guitar pick holder comprising:

a) a base having a lower surface for engaging an underlying support surface and an upper surface spaced above the lower surface;

b) a cavity in the base that communicates with the upper surface;

c) the cavity having a pair of opposed sockets, each extending down into the base from the upper surface, each socket forming an acute angle with the upper surface;

d) a coil spring having end portions, each end portion mounted in a different one of the sockets;

e) the coil spring having a central longitudinal curvature that provides an upper spring surface that is convex and a lower spring surface that is concave;

f) the upper convex surface providing gaps in between spring coils that enable guitar picks to be supported by two coils of the coil spring grasping the pick.

11. The guitar pick holder of claim 10 wherein one of the sockets is curved.

12. The guitar pick holder of claim 10 wherein both of the sockets are curved.

13. The guitar pick holder of claim 10 wherein the concave surface is supported along its length in between the ends of the coil spring by the base.

14. The guitar pick holder of claim 10 wherein the concave surface is continuously supported along its length in between the ends of the coil spring by the base.

15. The guitar pick holder of claim 10 wherein the coil spring defines an arc.

* * * * *